US008447215B2

(12) United States Patent
Kurahashi et al.

(10) Patent No.: US 8,447,215 B2
(45) Date of Patent: May 21, 2013

(54) IMAGE FORMING APPARATUS AND METHOD

(75) Inventors: Hideyuki Kurahashi, Toyokawa (JP); Takashi Gonda, Toyokawa (JP); Yoshiki Omichi, Toyokawa (JP); Tatsuyuki Sasaki, Toyokawa (JP); Masashi Kawai, Toyohashi (JP); Fumio Masuda, Sakai (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 287 days.

(21) Appl. No.: 13/046,337

(22) Filed: Mar. 11, 2011

(65) Prior Publication Data

US 2011/0229818 A1 Sep. 22, 2011

(30) Foreign Application Priority Data

Mar. 16, 2010 (JP) ..... 2010-058578

(51) Int. Cl.
*G03G 15/08* (2006.01)

(52) U.S. Cl.
USPC ..... 399/235; 399/359

(58) Field of Classification Search
USPC ..... 399/234, 235, 343, 358, 359, 360
See application file for complete search history.

(56) References Cited

U.S. PATENT DOCUMENTS

| | | | | |
|---|---|---|---|---|
| 5,638,159 | A | 6/1997 | Kai et al. | |
| 7,366,440 | B2 * | 4/2008 | Horikawa | 399/111 |
| 7,486,910 | B2 * | 2/2009 | Kitozaki | 399/111 |

FOREIGN PATENT DOCUMENTS

| | | | |
|---|---|---|---|
| JP | 11-133748 | A | 5/1999 |
| JP | 2002-031954 | A | 1/2002 |
| JP | 2004-061958 | A | 2/2004 |
| JP | 3581720 | B2 | 10/2004 |

* cited by examiner

*Primary Examiner* — Hoang Ngo
(74) *Attorney, Agent, or Firm* — Buchanan Ingersoll & Rooney PC

(57) ABSTRACT

An image forming apparatus includes a developing device that uses a developer carrier to advance to an image carrier a developer including a toner and a carrier and supplies the toner to the image carrier by applying a developing bias between the developer carrier and the image carrier. In the image forming apparatus, the following operation is performed before the developer in the developing device is taken out. The toner is supplied to the image carrier by applying the developing bias between the developer carrier and the image carrier, the developing bias increased in a direction to supply the toner to the image carrier. The toner supplied onto the image carrier is not transferred to a transfer receiving material but is advanced into a toner recovery device for recovery. The recovered toner is prevented from being returned to the developing device.

12 Claims, 4 Drawing Sheets

IMAGE FORMING APPARATUS AND METHOD

RELATED APPLICATION

This application is based on application No. 58578/2010 filed in Japan, the contents of which are hereby incorporated by reference.

BACKGROUND OF THE INVENTION

1. Field of the Invention

The present invention relates to an electrophotographic image forming apparatus such as copiers, printers, facsimiles and combined machines thereof as well as to an image forming method using the image forming apparatus. More particularly, the invention relates to an image forming apparatus and an image forming method thereof, the image forming apparatus including: a developing device that forms a toner image by using a development roller to advance to an image carrier a developer including a toner and a carrier and by using a voltage applicator to apply a developing bias between the development roller and the image carrier for supplying the toner onto the image carrier; a transfer device for transferring the toner image formed on the image carrier to a transfer receiving material; a toner recovery device for recovering the toner remaining on a surface of the image carrier after toner image transfer; and a transport mechanism for transporting to the developing device the toner recovered by the toner recovery device. In the image forming apparatus and method, the invention seeks to prevent wasteful discarding of the toner in the developer, which may encounter carrier deterioration while stored in the developing device.

2. Description of Related Art

It is a general practice in the electrophotographic image forming apparatus such as copiers, printers, facsimiles and combined machines thereof that the developing device supplies the toner to the image carrier with an electrostatic latent image formed thereon so as to form thereon a toner image corresponding to the electrostatic latent image. The transfer device transfers the toner image formed on the image carrier onto the transfer receiving material such as a recording medium or an intermediate transfer belt. Subsequently, the toner recovery device recovers from the surface of the image carrier the toner remaining after the toner image transfer. There is known an apparatus which employs returning means for returning the toner recovered by the toner recovery device to the developing device for the purpose of effective use of the recovered toner.

The above developing device includes a single component development device using a toner alone as the developer, and a two-component development device using a developer including the toner and the carrier. The two-component developing device using the developer including the toner and the carrier is superior in terms of quick and adequate toner charging for high-speed image formation.

In such a developing device of the two-component development system, the developer including the toner and the carrier is agitated to charge the toner in the developer by contact with the carrier. The developer with the charged toner is advanced to the image carrier by the development roller. The voltage applicator applies the developing bias between the development roller and the image carrier so as to supply the toner to the image carrier. Thus, the toner image corresponding to the electrostatic latent image is formed on the surface of the image carrier.

In a case where the developer is decreased in toner content as a result of the above-described toner supply to the image carrier, a toner replenisher replenishes the developing device with the toner.

The above developing device of the two-component development system has the following problem. While the developer is used over a long period of time, the carrier in the developer is gradually deteriorated so as to become incapable of adequately charging the toner. Accordingly, the developing device cannot accomplish proper image formation.

It has been a conventional practice to remove the developer with the deteriorated carrier from the developing device for replacement with a fresh developer or to replace the developing device per se with a new one.

However, in the case where the developer with the deteriorated carrier is removed from the developing device for replacement with a new one, or where the developing device itself is replaced with a new one, the developer actually contains a substantial amount of toner that is still usable. Namely, there is a problem that the usable toner in the developer is wastefully discarded.

More recently, there has been proposed an apparatus wherein the above developing device is equipped with separation means for separating the toner from the developer being recovered, as disclosed in Patent Document 1 (Japanese Patent Publication No. 3581720). The separation means includes a developer recovery portion and a toner recover portion and applies to a developer recovery sleeve a charge of the opposite polarity to that of the toner so as to separate the toner from the developer being recovered. The separated toner is returned to the developing device for recycling.

However, the constitution disclosed in Patent Document 1 requires the developing device to be equipped with many devices, resulting in cost increase. Furthermore, the developing device is increased in size.

SUMMARY OF THE INVENTION

The invention is directed to solution to a problem of an image forming apparatus including: a developing device that uses a development roller to advance to an image carrier a developer including a toner and a carrier and uses a voltage applicator to apply a developing bias between the development roller and the image carrier to thereby supply the toner to the image carrier; a transfer device for transferring a toner image formed on the image carrier to a transfer receiving material; a toner recovery device for recovering the toner remaining on a surface of the image carrier after the toner image transfer; and a transport mechanism for transporting to the developing device the toner recovered by the toner recovery device.

In the above image forming apparatus, an object of the invention is to provide easy prevention of the wasteful discarding of the toner present in the developer by permitting the toner to be adequately recovered from the developer without relying on a special device when the developer, suffering carrier deterioration, is removed from the developing device.

According to one aspect of the invention, an image forming apparatus for forming an image using a two-component developer including a toner and a carrier, comprises:

an image carrier capable of carrying an electrostatic latent image formed based on image data;

a removable developing device that includes a development roller disposed in opposed relation with the image carrier and that can supply the toner to the image carrier;

a transfer device capable of transferring a toner image on the image carrier to a transfer receiving material, the toner image formed by the toner supplied by the developing device;

a toner recovery device capable of recovering the toner not transferred to the transfer receiving material by the transfer device and remaining on the image carrier;

a transport mechanism transporting to the developing device the toner recovered by the toner recovery device;

a voltage applicator capable of applying a bias voltage between the image carrier and the development roller during an image forming operation in order to transfer the toner in the developer from the development roller to the image carrier; and a controller that, in the removal of the developing device, allows the toner recovery device to recover a larger amount of toner than that recovered in the image forming operation by controllably driving the voltage applicator to apply between the development roller and the image carrier the bias voltage shifted in a direction to transfer more toner (present in the developer) than in the image forming operation from the development roller to the image carrier and by controllably inhibiting the transfer device from transferring the toner to the transfer receiving material.

According to another aspect of the invention, an image forming method for forming an image using a two-component developer including a toner and a carrier, the method employs the above image forming apparatus, wherein in the removal of the developing device, the controller allows the toner recovery device to recover a larger amount of toner than that recovered in the image forming operation by controllably driving the voltage applicator to apply between the development roller and the image carrier the bias voltage shifted in a direction to transfer more toner (present in the developer) than in the image forming operation from the development roller to the image carrier and by controllably inhibiting the transfer device from transferring the toner to the transfer receiving material.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Now, an image forming apparatus according to an embodiment of the invention will be described in detail with reference to the accompanying drawings. It is to be noted that the image forming apparatus of the invention is not limited to the following embodiment but changes or modifications may be made thereto as needed so long as such changes or modifications do not depart from the scope of the invention.

Figure 1:
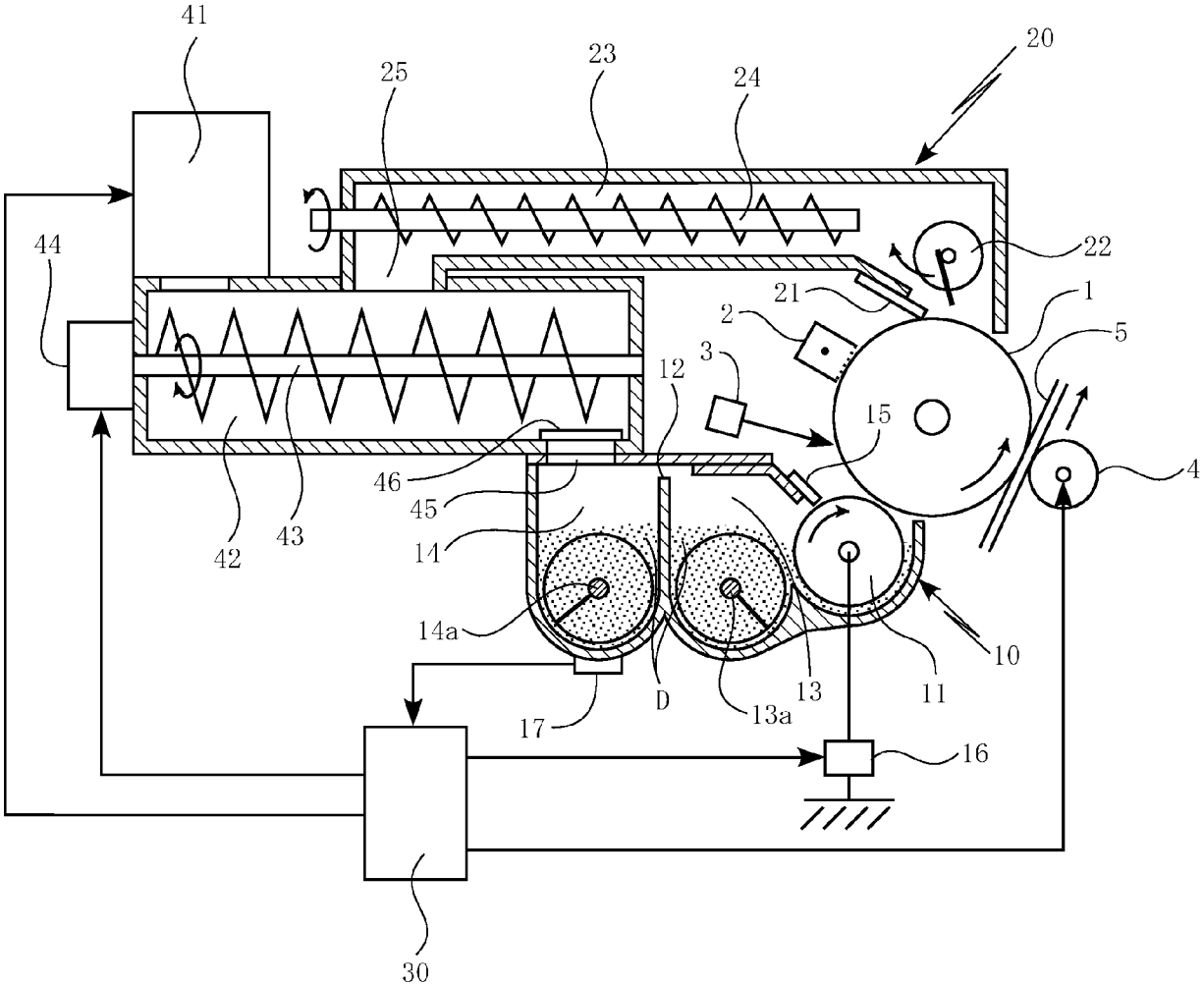
FIG. 1 is a partial diagrammatic illustration of an image forming apparatus according to one embodiment of the invention.

The image forming apparatus of the embodiment operates as follows. As shown in FIG. 1, a surface of an image carrier 1 comprising a rotary photosensitive drum is charged by a charger 2. Subsequently, a latent image forming device 3 exposes the surface of the image carrier 1 to a laser beam or the like according to image information, to thereby form on the image carrier 1 an electrostatic latent image corresponding to the image information.

A developing device 10 containing therein a developer D including a toner and a carrier supplies the toner in the developer D to the electrostatic latent image formed on the image carrier 1. Thus, a toner image corresponding to the electrostatic latent image is formed on the image carrier 1.

Subsequently, the toner image thus formed on the image carrier 1 is advanced to place opposite a transfer device 4. At this time, a transfer receiving material such as a recording medium or an intermediate transfer belt is inserted in space between the image carrier 1 and the transfer device 4, so that the toner image formed on the image carrier is transferred onto the transfer receiving material 5 by the transfer device 4.

A toner recovery device 20 is provided with a cleaning member 21, an end of which is pressed against the surface of the image carrier 1 after image transfer so that the toner remaining on the surface of the image carrier 1 is recovered by the cleaning member 21 and collected in the toner recovery device 20.

The toner thus recovered from the surface of the image carrier 1 and collected in the toner recovery device 20 is returned to the developing device 10 by operating a transport mechanism.

It is noted here that the term "transport mechanism" means a mechanism serving to return to the developing device the toner that was not transferred to the transfer receiving material 5 by the transfer device 4 and was left remaining on the image carrier 1. Specifically, the transport mechanism returns the toner to the developing device 10 by using a screw conveyor comprising a recovered-toner transporting member 24 and a toner transporting member 43 as will be described hereinlater.

In the developing device 10, a developer carrier 11 comprising a rotary development roller is disposed in opposed relation with the image carrier 1. The developing device 10 also contains therein a partitioning wall 12 extending in an axial direction of the developer carrier 11. The partitioning wall divides the interior of the developing device 10 into a first developer transport portion 13 and a second developer transport portion 14, which are provided with a first agitating/transporting member 13*a* and a second agitating/transporting member 14*a*, respectively. The agitating/transporting members transport the developer D as agitating the same.

The first agitating/transporting member 13*a* and the second agitating/transporting member 14*a* are driven into rotation so that the developer D in the first developer transport portion 13 is transported along the developer carrier 11 and supplied thereto while the developer D in the second developer transport portion 14 is transported in the opposite direction to the transport direction of the first developer transport portion 13. That is, the developer D is circulated between the second and first developer transport portions through circulation ports (not shown) formed at opposite ends of the partitioning wall 12.

As described above, the developing device 10 supplies the toner in the developer D to an area of the electrostatic latent image formed on the image carrier 1 thereby forming the toner image on the image carrier 1 in correspondence to the electrostatic latent image. While the developer carrier 11 is rotated to transport to the image carrier 1 the developer D supplied to the developer carrier 11, the amount of developer D carried on the developer carrier 11 to place opposite the image carrier 1 is regulated by a regulating member 15.

The developer carrier 11 transports the regulated developer D to place opposite the image carrier 1. On the other hand, a controller 30 properly controls a developing bias that a bias source 16 applies between the developer carrier 11 and the image carrier 1, thereby adequately supplying the toner in the developer D to the area of the electrostatic latent image formed on the image carrier 1. Thus, the toner image corresponding to the electrostatic latent image is formed on the image carrier 1.

In the developing device 10, the second developer transport portion 14 is provided with a toner density sensor 17 for detecting the amount of toner in the developer D. In a case where the developer D is significantly decreased in the toner content as a result of supplying the toner in the developer D to the surface of the image carrier 1, the toner density sensor 17 detects this toner decrease and outputs the detection result to the controller 30.

In the case where the toner content of the developer D falls to a predetermined value or less, the controller 30 causes a toner replenisher 41 to supply the toner to a toner supply path 42. Further, the controller causes a rotating device 44 to rotate the toner transporting member 43 comprising a screw member disposed in the toner supply path 42 to thereby transport the toner replenished in the toner supply path 42. The toner is advanced to a toner supply port 45 provided between the toner supply path 42 and the second developer transport portion 14 so as to be replenished in the second developer transport portion 14 of the developing device 10 via the toner supply port 45.

The toner recovery device 20 recovers the toner from the surface of the image carrier 1, as described above, and the recovered toner is returned by returning means to the developing device 10 as follows. The toner recovery device 20 is provided with a recovered-toner advancing member 22 which is a rotary member. The toner recovered by the cleaning member 21 from the surface of the image carrier 1 is advanced by the recovered-toner advancing member 22 into a recovered-toner transport path 23.

The recovered-toner transport path 23 contains therein the recovered-toner transporting member 24 for transporting the toner thus recovered and advanced therein. The recovered-toner transporting member 24 is rotated to transport the recovered toner in the recovered-toner transport path 23 to a recovered-toner inlet port 25 provided between the recovered-toner transport path 23 and the toner supply path 42. The recovered toner is fed into the toner supply path 42 via the recovered-toner inlet port 25.

In the same way as in the above described toner replenishment, the recovered toner fed into the toner supply path 42 is transported by rotating the toner transporting member 43. The recovered toner is advanced to the toner supply port 45 provided between the toner supply path 42 and the second developer transport portion 14. Through this toner supply port 45, the recovered toner is returned to the second developer transport portion 14 of the developing device 10.

While the developing device 10 in the image forming apparatus of the embodiment carries out the development as described above, the developer D is agitated by the first agitating/transporting member 13*a* and the second agitating/transporting member 14*a* and hence, the carrier in the developer D is gradually deteriorated.

Hence, the image forming apparatus of this embodiment takes the following procedure. Before the developer D suffering the above-described carrier deterioration is taken out from the developing device 10, the toner is recovered from the developer D stored in the developing device 10 and is prevented from being transported back into the developing device 10 so as to be stored in the apparatus.

Figure 2:
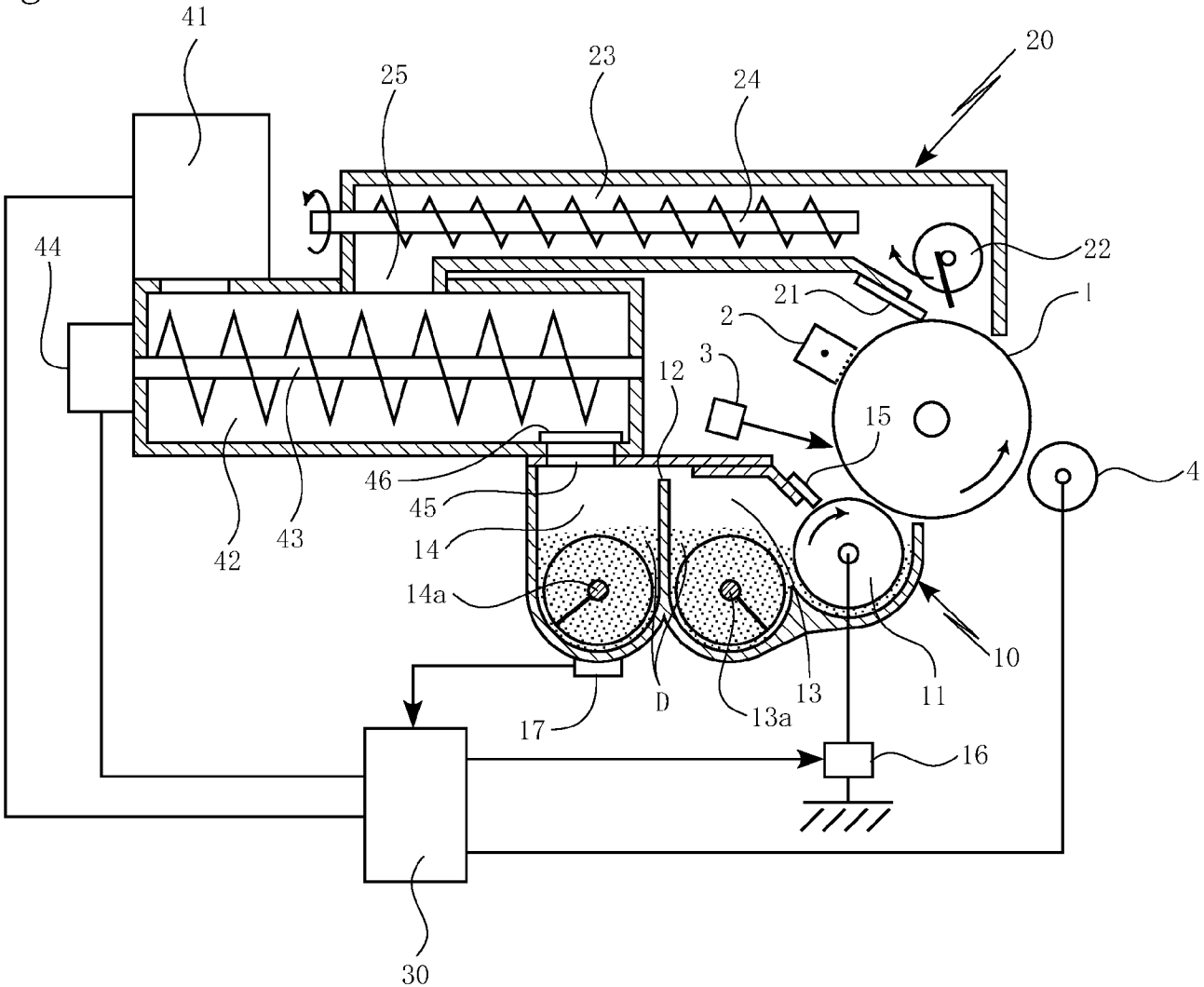
FIG. 2 is a partial diagrammatic illustration showing a state where a transport mechanism of the image forming apparatus of the one embodiment hereof stops transporting a developer.

In the image forming apparatus of the embodiment, the following steps are taken to recover the toner from the developer D in the developing device 10 and to store the recovered toner in the apparatus. In the same way as the operation shown in FIG. 1, the charger 2 charges the surface of the image carrier 1 and thereafter, the latent image forming device 3 exposes the surface of the image carrier 1 to light so as to form an electrostatic latent image on the image carrier 1, as shown in FIG. 2.

The following operation is performed when the developing device 10 supplies the toner in the developer D to the electrostatic latent image thus formed on the image carrier 1. The controller 30 controls the voltage applicator 16 in a manner such that the developing bias applied between the development roller 11 and the image carrier 1 is shifted in a direction to transfer more toner than in the image forming operation from the development roller 11 to the image carrier 1. This reduces the carrier supplied from the developer D to the image carrier 1 and increases the toner supplied from the developer D to the image carrier 1. During a normal image forming operation, for example, a developing bias of 500V $|Vb1|$ is applied between the development roller 11 and the image carrier 1. During an operation to recover the toner from the developer in the developing device 10, on the other hand, a developing bias of 700V $|Vb2|$ is applied between the development roller 11 and the image carrier 1.

Figure 3:
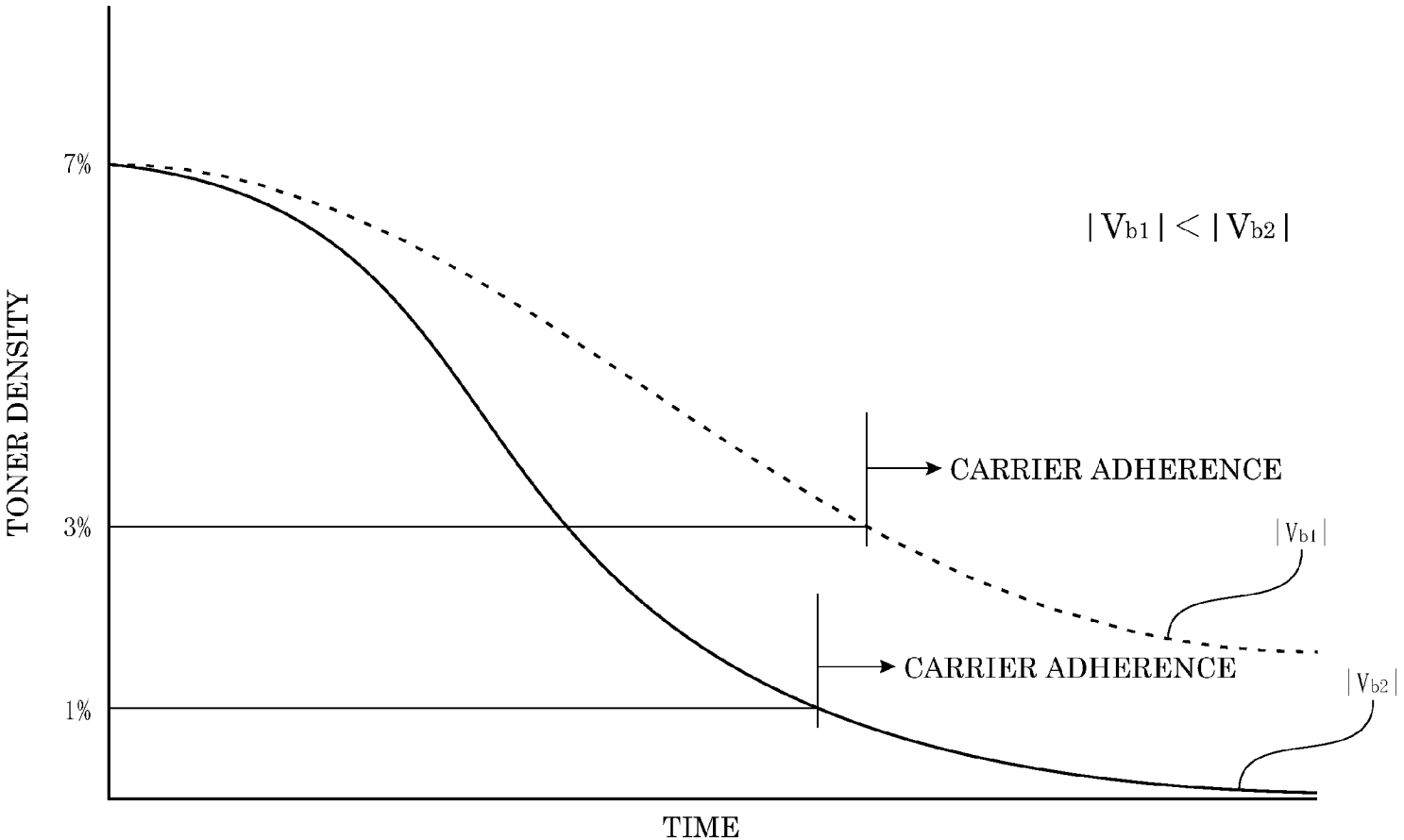
FIG. 3 is graph indicating that a carrier in the developer is inhibited from adherence to an image carrier of the image forming apparatus of the one embodiment hereof if a developing bias applied between a developer carrier and the image carrier is increased in a direction to supply a toner to the image carrier.

If the developing bias $|Vb|$ applied between the developer carrier 11 and the image carrier 1 is shifted in the direction to transfer more toner than in the image forming operation from the development roller 11 to the image carrier 1, little of the carrier in the developer D is supplied to the image carrier 1 while much of the toner in the developer D is supplied to the image carrier 1, as shown in FIG. 3. Consequently, the developer D in the developing device 10 is adequately decreased in the toner content.

In the operation to recover the toner from the developer in the developing device, it is preferred that the latent image forming device 3 forms on the image carrier 1 an electrostatic latent image corresponding to a solid image in order to increase further the amount of toner supplied to the image carrier 1.

On the other hand, the controller 30 inhibits the transfer receiving material 5 from being inserted in space between the image carrier 1 thus supplied with the toner and the transfer device 4. The controller 30 also causes the transfer device 4 to be moved away from the image carrier 1 in order to ensure that the toner supplied to the surface of the image carrier 1 is not transferred to the transfer receiving material 5 but is advanced to the toner recovery device 20.

The image forming apparatus of the embodiment is provided with a spacer mechanism (not shown) for moving the transfer device 4 away from the image carrier 1. The transfer device 4 is moved away from the image carrier 1 by the spacer mechanism. This embodiment uses the spacer mechanism to move the transfer device 4 away from the image carrier 1 thereby inhibiting the toner on the image carrier 1 from being transferred to the transfer device 4. However, the invention is not limited to this. The invention may adopt any other constitution or control that inhibits the toner on the image carrier 1 from being transferred to the transfer device 4. For example, it is also possible to inhibit the application of transfer voltage to the transfer device 4 to thereby prevent the toner on the image carrier 1 from being transferred to the transfer device 4.

In the toner recovery device 20, on the other hand, the toner supplied onto the image carrier 1 is recovered therefrom by the cleaning member 21. The toner thus recovered is advanced into the recovered-toner transport path 23 by operating the rotary recovered-toner advancing member 22. Next, the recovered-toner transporting member 24 transports the toner in the recovered-toner transport path 23 to the recovered-toner inlet port 25 between the recovered-toner transport path 23 and the toner supply path 42. The recovered toner is advanced into the toner supply path 42 via the recovered-toner inlet port 25.

In the toner supply path 42 into which the toner is advanced in this manner, the rotation of the toner transporting member 43 driven by the rotating device 44 is stopped by the controller 30. The controller 30 inhibits the toner transporting member 43 from transporting the toner advanced into the toner supply path 42. Namely, the toner advanced into the toner supply path 42 is not returned to the developing device 10 via the toner supply port 45 but is stored in a storage portion comprising the toner supply path 42.

Accordingly, the toner in the developer D stored in the developing device 10 is sequentially supplied to the image carrier 1 and stored in the storage portion comprising the toner supply path 42, so that the developer D stored in the developing device 10 is gradually decreased in the toner content. Particularly if the developing bias applied between the development roller 11 and the image carrier 1 is shifted in the direction to transfer more toner than in the image forming operation from the development roller 11 to the image carrier 1 as described above, little of the carrier in the developer D is supplied to the image carrier 1 while much of the toner in the developer D is supplied to the image carrier 1. The toner so supplied is recovered by the toner recovery device 20 and stored in the storage portion comprising the toner supply path 42, as described above. In consequence, the developer D contains very little toner.

The amount of wastefully discarded toner is notably reduced if the developer D in the developing device 10 is minimized in the toner content before the developer D is replaced with a new one or the developing device 10 per se is replaced with a new one.

If after the above-described replacement of the developer D in the developing device 10 with a fresh developer or replacement of the developing device 10 with a new developing device, the toner stored in the storage portion defined by the toner supply path 42 is supplied to the developing device 10 via the toner supply port 45, the stored toner is used effectively.

The image forming apparatus of the embodiment is provided with a shutter mechanism 46 for opening or closing the toner supply port 45. The shutter mechanism reliably prevents the toner recovered by the toner recovery device 20 and advanced into the toner supply path 42 from being returned to the developing device 10 via the toner supply port 45 when the recovered toner is stored in the toner supply path 42. To store the recovered toner in the toner supply path 42, the toner supply port 45 is closed by the shutter mechanism 46.

Alternatively, a storage portion independent from the above toner supply path 42 may also be provided to store the recovered toner therein.

According to the above embodiment, replacement time for the developing device 10 is illustrated as time to remove the developing device 10, which is not limited to this. For example, the developing device 10 may be removed for replacement of the carrier.

Figure 4:
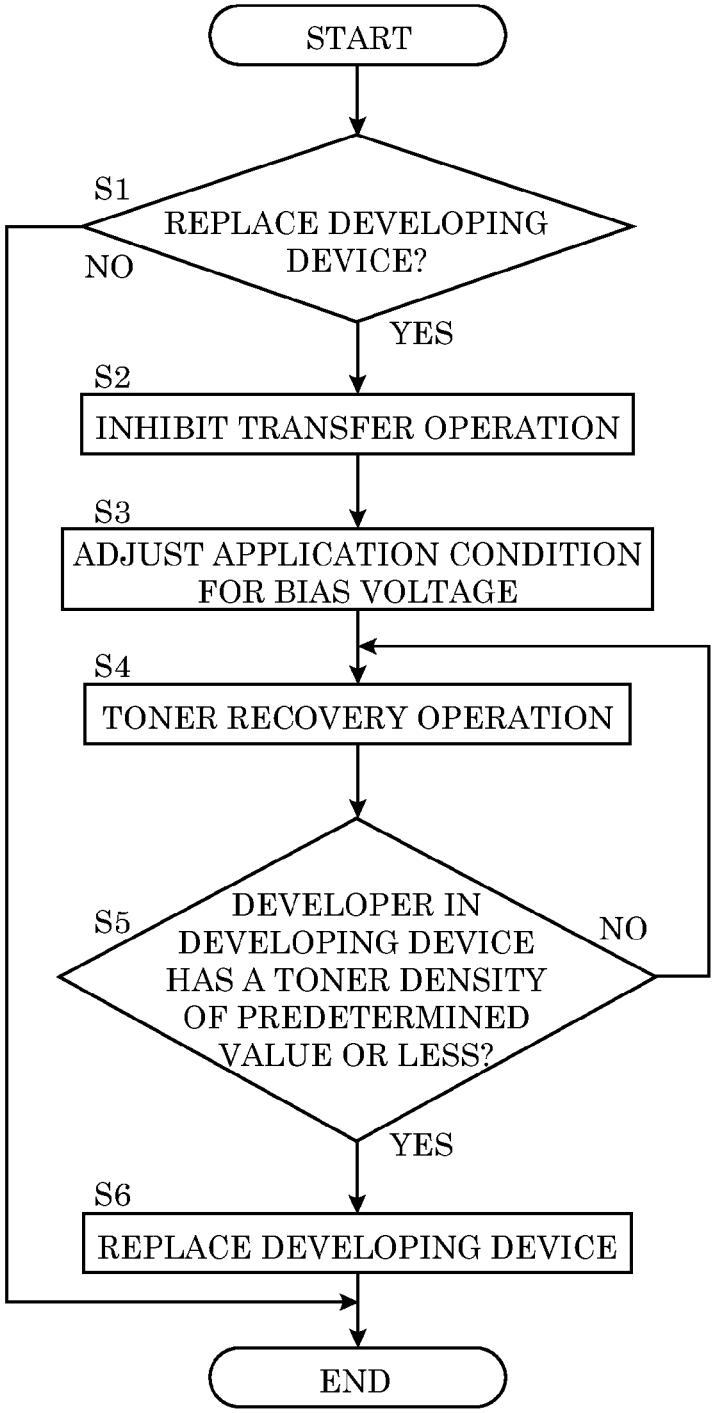
FIG. 4 is a flow chart showing the steps of a toner recovery operation performed by the image forming apparatus of the one embodiment hereof.

Now referring to a flow chart of FIG. 4, description is made on a toner recovery operation performed by the image forming apparatus of the embodiment.

The operation illustrated by the flow chart is executed at a previously programmed, suitable time such as when the image forming apparatus is switched on or is in a standby mode.

Firstly in Step S1, determination is made as to whether it is time to replace the developing device 10 or not. Whether it is time to replace the developing device 10 or not is determined based on the sum of printed sheets as counted from the previous replacement of the developing device. Specifically, the replacement time for the developing device 10 is determined based on whether the number of printed sheets has reached 150000 or not. If the number of printed sheets is less than 150000 so that the replacement of the developing device 10 is not required ("No" in Step S1), the operation of the flow chart is terminated.

On the other hand if the number of printed sheets has reached 150000, requiring the replacement of the developing device 10 ("Yes" in Step S1), the operation proceeds to Step S2 to inhibit a transfer operation by the transfer device 4. Specifically, the transfer device 4 is moved away from the image carrier 1 by the spacer mechanism.

Next, the operation proceeds to Step S3 where application condition for the developing bias is adjusted. The developing bias applied between the image carrier 1 and the developer carrier 11 is adjustably shifted in the direction to transfer more toner than in the image forming operation from the development roller 11 to the image carrier 1. Specifically, a developing bias of 500V is applied between the image carrier 1 and the developer carrier 11 during the image forming operation. During the toner recovery operation, a developing bias of 700V is applied between the image carrier 1 and the developer carrier 11. If the developing bias is increased in the direction to transfer the toner to the image carrier, the carrier is inhibited from adherence to the image carrier 1, as shown in FIG. 3. Therefore, the toner becomes more movable toward the image carrier 1 whereas the carrier becomes less movable toward the image carrier. Hence, the developer in the developing device 10 is prone to decrease in the toner density.

The toner recovery operation in Step S4 is performed after the condition is established wherein more toner than in the image forming operation is transferred from the development carrier 11 to the image carrier 1 while the toner transfer from the image carrier 1 to the transfer device 4 is inhibited. Namely, the developer carrier 11 supplies the toner in the developing device 10 to the image carrier 1 while the supplied toner is recovered by the toner recovery device 20. The toner recovered by the toner recovery device 20 is transported to the recovered-toner transport path 23 and the toner supply path 42.

In the subsequent Step S5, determination is made as to whether the toner density of the developer in the developing device 10 is reduced to below a predetermined value or not. If the toner density of the developer in the developing device 10 is not below the predetermined value ("No" in Step S5), the operation returns to Step S4 to repeat the toner recovery operation till the toner density is reduced to below the predetermined value. On the other hand, when the toner density of the developer in the developing device 10 is reduced to below the predetermined value ("Yes" in Step S5), the recovered-toner transporting member 24 and the toner transporting member 43 are deactivated. In Step S6, a message prompting the replacement of the developing device 10 is given.

In a case where the toner supply port 45 is provided with the shutter mechanism 46, the following procedure may be taken. When the toner density of the developer in the developing device 10 is reduced to below the predetermined value ("Yes" in Step S5), the shutter mechanism 46 is operated to close the toner supply port 45 in association with the deactivation of the recovered-toner transporting member 24 and the toner transporting member 43 or instead of deactivating these components.

According to the image forming apparatus of the invention as described above, the controller 30 controls the voltage applicator 16 as follows before the developing device 10 is removed from the apparatus. Namely, the voltage applicator applies between the development roller 11 and the image carrier 1 the developing bias increased in the direction to transfer more toner (in the developer D) than in the image forming operation from the development roller 11 to the image carrier 1. Therefore, little of the carrier in the developer D is supplied to the image carrier 1 while much of the toner in the developer D is supplied to the image carrier 1.

As described above, the controller 30 causes the toner supplied onto the image carrier 1 to be advanced into the toner recovery device 20 but not to be transferred onto the transfer receiving material 5 while inhibiting the transport mechanism from returning the toner to the developing device 10, the transport mechanism comprising the recovered-toner transporting member 24 and the like. Thus, a substantial amount of toner supplied onto the image carrier 1 is not transferred onto the transfer receiving material 5 but is recovered from the surface of the image carrier 1 by the toner recovery device 20. The recovered toner is stored instead of being returned to the developing device 10 so that the developer D stored in the developing device 10 is gradually decreased in the toner content. Particularly, the bias voltage applied between the development roller 11 and the image carrier 1 is increased in the direction to transfer more toner (in the developer D) than in the image forming operation from the development roller 11 to the image carrier 1. Namely, the force acting in the direction to supply the toner to the image carrier 1 is increased. This allows much of the toner in the developer D to be supplied to the image carrier 1 while little of the carrier in the developer D is supplied to the image carrier 1. The toner thus supplied is recovered by the toner recovery device 20 and stored so that the developer D contains very little toner.

According to the image forming apparatus of the invention, therefore, the developer D contains very little toner when the developer D in the developing device 10 is replaced with a new developer D or the developing device 10 per se is replaced with a new developing device 10. Thus is prevented the wasteful discarding of toner and the effective use of the toner is accomplished.

In the image forming apparatus of the invention that includes the toner supply path 42 serving as the storage portion for temporarily storing the toner recovered by the toner recovery device 20 before the recovered toner is transported to the developing device 10, and the shutter mechanism 46 provided at place between the toner supply path 42 and the developing device 10 for blocking the toner transfer, the controller 30 may operate as follows. Just before the removal of the developing device 10, the controller 30 drives the shutter mechanism 46 to block the toner supply to the developing device 10. This ensures that the toner recovered by the toner recovery device 20 is not returned to the developing device 10 but is stored in the toner supply path 42. Hence, the developer D stored in the developing device 10 is decreased in the toner content.

In the image forming apparatus of the invention that includes the screw conveyor including the recovered-toner transporting member 24 for transporting the toner recovered by the toner recovery device 20 and the toner transporting member 43, the controller 30 may operate as follows. Just before the removal of the developing device 10, the controller 30 deactivates the screw conveyor so as to stop the transportation of the recovered toner. Just as in the above case, the toner recovered by the toner recovery device 20 is not returned to the developing device 10 so that the developer D stored in the developing device 10 is decreased in the toner content.

In the image forming apparatus of the invention, the controller 30 controls the voltage application by the voltage applicator 16 just before the removal of the developing device 10. In this control, the controller 30 can also change at least one of a direct current component and an alternating current component of the bias voltage applied between the development roller 11 and the image carrier 1.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus for forming an image using a two-component developer including a toner and a carrier, comprising:

an image carrier capable of carrying an electrostatic latent image formed based on image data;

a removable developing device that includes a development roller disposed in opposed relation with the image carrier and that can supply the toner to the image carrier;

a transfer device capable of transferring a toner image on the image carrier to a transfer receiving material, the toner image formed by the toner supplied by the developing device;

a toner recovery device capable of recovering the toner not transferred to the transfer receiving material by the transfer device and remaining on the image carrier;

a transport mechanism transporting to the developing device the toner recovered by the toner recovery device;

a voltage applicator capable of applying a bias voltage between the image carrier and the development roller during an image forming operation in order to transfer the toner in the developer from the development roller to the image carrier; and a controller that, in the removal of the developing device, allows the toner recovery device to recover a larger amount of toner than that recovered in the image forming operation by controllably driving the voltage applicator to apply between the development roller and the image carrier the bias voltage shifted in a direction to transfer more toner (in the developer) than in the image forming operation from the development roller to the image carrier and by controllably inhibiting the transfer device from transferring the toner to the transfer receiving material.

2. The image forming apparatus according to claim 1, wherein the transport mechanism includes: a storage portion for temporarily storing the toner before the toner is transported to the developing device, and a shutter mechanism for blocking the toner transfer between the storage portion and the developing device, and wherein just before the removal of the developing device, the controller controls the transport mechanism in order to cause the shutter mechanism to block the toner transfer to the developing device.

3. The image forming apparatus according to claim 1, wherein the transport mechanism includes a screw conveyor for transporting the toner, and wherein just before the removal of the developing device, the controller controls the transport mechanism in order to stop the toner transportation by deactivating the screw conveyer.

4. The image forming apparatus according to claim 1, wherein just before the removal of the developing device, the controller controls the voltage applied by the voltage applicator in a manner to change at least one of a direct current component and an alternating current component of the bias voltage applied between the development roller and the image carrier.

5. The image forming apparatus according to claim 1, further comprising a latent image forming device for forming the electrostatic latent image on a surface of the image carrier, wherein just before the removal of the developing device, the controller operates the latent image forming device to form, on the surface of the image carrier, an electrostatic latent image corresponding to a solid image.

6. The image forming apparatus according to claim 1, further comprising:

a toner supply path allowing the transport mechanism to transport a toner replenished from a toner replenisher to the developing device; and a storage portion independent from the toner supply path and serving to store the toner recovered by the toner recovery device.

7. An image forming method for forming an image using a two-component developer including a toner and a carrier, the method employing an image forming apparatus comprising:

an image carrier capable of carrying an electrostatic latent image formed based on image data;

a removable developing device that includes a development roller disposed in opposed relation with the image carrier and that can supply the toner to the image carrier;

a transfer device capable of transferring a toner image on the image carrier to a transfer receiving material, the toner image formed by the toner supplied by the developing device;

a toner recovery device capable of recovering the toner not transferred to the transfer receiving material by the transfer device and remaining on the image carrier;

a transport mechanism transporting to the developing device the toner recovered by the toner recovery device;

a voltage applicator capable of applying a bias voltage between the image carrier and the development roller during an image forming operation in order to transfer the toner in the developer from the development roller to the image carrier; and a controller for controlling the voltage applicator and the transfer device, wherein in the removal of the developing device, the controller allows the toner recovery device to recover a larger amount of toner than that recovered in the image forming operation by controllably driving the voltage applicator to apply between the development roller and the image carrier the bias voltage shifted in a direction to transfer more toner (in the developer) than in the image forming operation from the development roller to the image carrier and by controllably inhibiting the transfer device from transferring the toner to the transfer receiving material.

8. The image forming method according to claim 7, wherein the transport mechanism includes: a storage portion for temporarily storing the toner before the toner is transported to the developing device, and a shutter mechanism for blocking the toner transfer between the storage portion and the developing device, and wherein just before the removal of the developing device, the controller controls the transport mechanism in order to cause the shutter mechanism to block the toner transfer to the developing device.

9. The image forming method according to claim 7, wherein the transport mechanism includes a screw conveyor for transporting the toner, and wherein just before the removal of the developing device, the controller controls the transport mechanism in order to stop the toner transportation by deactivating the screw conveyer.

10. The image forming method according to claim 7, wherein just before the removal of the developing device, the controller controls the voltage applied by the voltage applicator in a manner to change at least one of a direct current component and an alternating current component of the bias voltage applied between the development roller and the image carrier.

11. The image forming method according to claim 7, further comprising a latent image forming device for forming the electrostatic latent image on a surface of the image carrier, wherein just before the removal of the developing device, the controller operates the latent image forming device to form, on the surface of the image carrier, an electrostatic latent image corresponding to a solid image.

12. The image forming method according to claim 7, further comprising:

a toner supply path allowing the transport mechanism to transport a toner replenished from a toner replenisher to the developing device; and a storage portion independent from the toner supply path and serving to store the toner recovered by the toner recovery device.

* * * * *